United States Patent [19]

Lange

[11] 4,164,118

[45] Aug. 14, 1979

[54] APPARATUS FOR POSITIONING THE LINKS OF A LENGTH OF CHAIN

[75] Inventor: Gerhard Lange, Reutlingen, Fed. Rep. of Germany

[73] Assignee: Wafios, Maschinenfabrik, Wagner, Ficker & Schmid (GmbH & Co. KG), Fed. Rep. of Germany

[21] Appl. No.: 821,458

[22] Filed: Aug. 3, 1977

[30] Foreign Application Priority Data

Aug. 12, 1976 [DE] Fed. Rep. of Germany ..... 2636220

[51] Int. Cl.[2] ..... B21L 3/02

[52] U.S. Cl. ..... 59/31

[58] Field of Search ..... 59/1, 3, 16, 18, 22, 59/23, 25, 26, 31, 33, 34, 35; 219/51, 52

[56] References Cited

U.S. PATENT DOCUMENTS

| | | | |
|---|---|---|---|
| 3,906,183 | 9/1975 | Lange | 219/51 |
| 3,934,407 | 1/1976 | Lange | 59/35 R |

FOREIGN PATENT DOCUMENTS

| | | | |
|---|---|---|---|
| 41138 | 2/1910 | Austria | 219/51 |
| 2408971 | 8/1975 | Fed. Rep. of Germany | 59/34 |
| 1185511 | 2/1959 | France | 59/22 |

*Primary Examiner*—Charlie T. Moon
*Assistant Examiner*—Gene P. Crosby
*Attorney, Agent, or Firm*—Wigman & Cohen

[57] ABSTRACT

A device for positioning the individual links of a length of chain having links to be welded is disclosed. The device is used in connection with a chain welding machine wherein a length of chain is advanced step-by-step upwardly over a vertex defined by a saddle at which a welding station is located and then downwardly. The saddle is advantageously formed of a generally cylindrical, horizontally extending bolt affixed to the machine and which has a flattened top portion to which each chain link to be welded is advanced then erected for welding. Alternate links arrive at the flattened top of the bolt with the planes of successive links arranged at inclinations of 45° to either side of a vertical plane containing the axis of the length of chain under the influence of the shape of the saddle and gravity.

5 Claims, 4 Drawing Figures

Fig. 1.
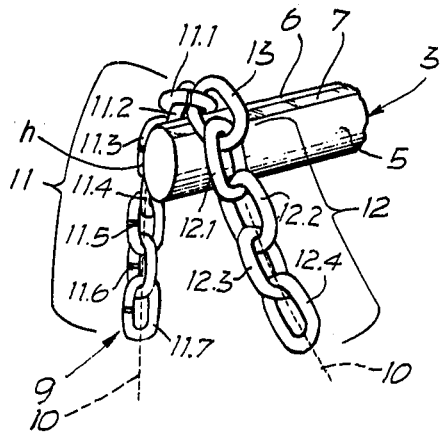
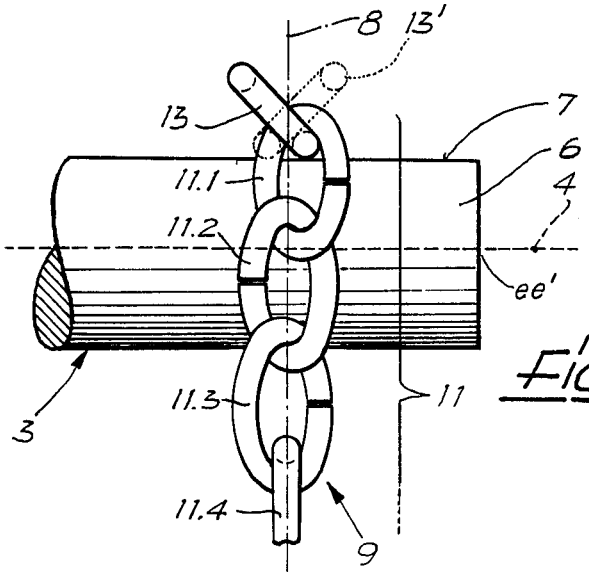
Fig. 2.

APPARATUS FOR POSITIONING THE LINKS OF A LENGTH OF CHAIN

BACKGROUND OF THE INVENTION

The present invention relates to a device for positioning the chain links of a length of chain which is moved, step-by-step, from bottom to top and, subsequently, from top to bottom over a vertex, in the region of the vertex located in a vertical median plane containing the axis of the length of chain wherein a saddle defines the vertex.

From prior West German Pat. No. 2,347,768, a method and apparatus for the production of chains are known in the case of which the adjacent ends of the wire of each chain link are welded together in a welding station in which the chain link to be welded is held in a certain plane after having been turned into such plane. It is characteristic of this method and apparatus that the chain links are guided in two planes upstream of the welding station which planes form an angle of about ±45° with said certain plane. Additionally, the known device has, for example, two first guide surfaces, one of which rests against the lower straight wire sections of chain links of a first row and the other first guide surface rests against the upper straight wire sections of these chain links and two section guide surfaces, one of which rests against the lower straight wire sections of chain links of a second row alternating by one chain link relative to the first row and the other second guide surface rests against the upper straight wire sections of the chain links of the second row. In particular, two parallel ledges can be provided, each having two plane sides forming a wedge comprising a wedge angle of about 90° whereby the two sides of each ledge form one of the two first guide surfaces or one of the two second guide surfaces and the two wedges engage from opposite sides between the two rows of chain links.

This known device actually fulfills the task on which it is based to a large extent, i.e., to provide a device of a certain type for the production of chains which is of a simple and appropriate structure. However, since the development of this prior device, it has been determined that the guiding of the chain links to be welded by means of ledges or such is not the simplest manner for the positioning of the chain links in two planes inclined 45° from a vertical plane.

SUMMARY AND OBJECTS OF THE INVENTION

Therefore, the present invention is based on the task of providing a device of the type mentioned in the foregoing which represents a better solution of the task upon which the known device is based with regard to a structure for the device which is as simple as possible.

This task, proceeding from a device of the aforementioned type, has been achieved by the invention by the fact that the saddle has a cylindrical supporting surface, the directrix of which lies in a vertical median plane and the generatrix of which is horizontally directed. Such a saddle supports the chain links positioned in the region of the vertex of the saddle in such a manner that they are self-arranged under the influence of gravity such that the chain link positioned at the vertex need only be erected about 45° into the median plane for welding. Thus, the guide on the feeding side of a chain welding machine, which heretofore has been considered necessary, is eliminated in a chain welding machine in which the device according to the invention is utilized.

In the case of a preferred embodiment of the device according to the invention, at least a part of the cylindrical supporting surface has a circular directrix with the cylindrical supporting surface having two sections with concentric circular directrices and a plane horizontal section arranged therebetween which is more suitable than a cylindrical section of the supporting surface for the purpose of supporting the lower straight section of an oval chain link located at the vertex. Furthermore, cylindrical surface sections can be produced more easily than other forms which would, additionally, result in less effective positioning of the chain link to be welded. The saddle can, for example, consist of a round bolt rigidly fixed to the welding machine structure with a diameter appropriate for the dimensions of the chain link and the top of which bolt has been flattened by means of milling.

BRIEF DESCRIPTION OF THE DRAWINGS

The invention is explained in detail below by means of an embodiment of the positioning device according to the invention shown in the drawings, wherein:

FIG. 1 is a perspective view of a first embodiment of the invention shown in connection with a length of chain;

FIG. 2 is a lateral view of the device shown in FIG. 1 and

DETAILED DESCRIPTION OF A PREFERRED EMBODIMENT

Figure 3B:
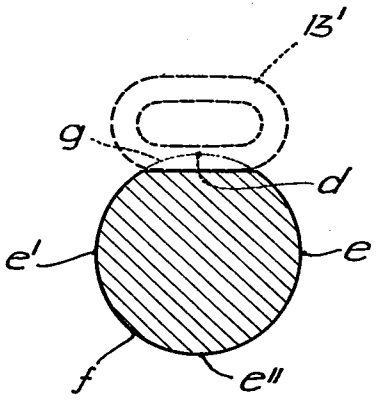
FIGS. 3A and 3B are lateral and cross-sectional views respectively of a second embodiment of the saddle of the invention.

The invention consists of an essentially round bolt 3 rigidly fixed to a chain welding machine structure (not shown). The bolt 3 has a horizontal axis 4 and a supporting surface forming its circumference which has two circular-cylindrical sections 5 and 6 blending into each other and a plane horizontal section 7 arranged over sections 5 and 6. In the first embodiment shown in FIGS. 1 and 2, the cylindrical supporting surface, consisting of the surface sections 5 to 7 is, therefore, defined by an almost circular (elliptical) directrix h which lies in a median plane 8 extending vertically with respect to the axis 4 of the bolt 3, but otherwise arranged in any way, and by a generatrix ee which is perpendicular to this median plane 8 and is recognizable in FIG. 2 by its straight trace.

Figure 3A:
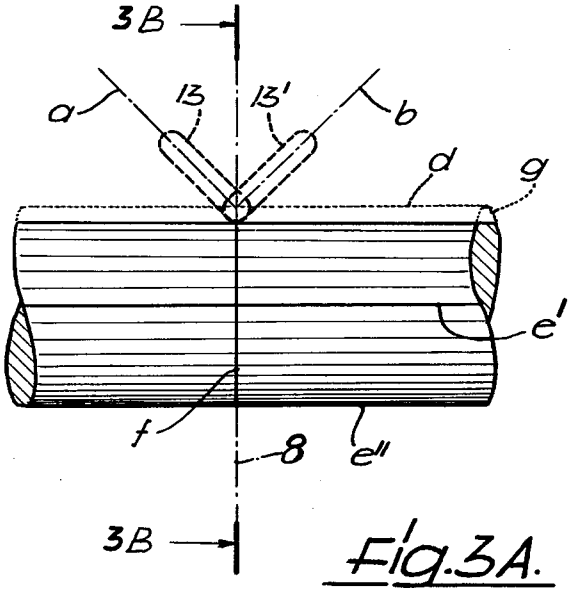

In the second embodiment shown in FIGS. 3A and 3B, the cylindrical supporting surface is defined by a circular directrix f which lies in the median plane 8 extending vertically and by a generatrix e′ which is perpendicular to this median plane 8. A removed portion of the circular directrix f is shown by line g to define the plane horizontal section 7 comprising a flattened top portion of the bolt 3. Different positions of the generatrix e′ during its displacement along the fixed curved line or circular directrix f are exemplified by the lines e and e″ which are shown in cross-section in FIG. 3B. A vertex d is located in the vertical median plane 8 containing the longitudinal axis 10 of the length of chain 9. The chain 9 is movable step-by-step upwardly then downwardly over the vertex d defined by a saddle.

The elongate bolt 3 forms the saddle for the positioning of the chain links of a length of chain 9, such length of chain not being completely shown in the drawing and which is placed over the bolt 3 with no guiding elements, i.e., the chain being freely suspended at the bolt 3. At least within the range of the bolt 3, the non-rectilinear longitudinal axis 10 of the length of chain 9 lies in the median plane 8. The length of chain 9 consists of an upwardly advancing section 11 with several oval chain links 11.1, 11.2, 11.3, etc. shown on the left hand side of FIG. 1, a downwardly discharging section 12 with several oval chain links 12.1, 12.2, 12.3, etc, shown on the right hand side of FIG. 1 and a single oval chain link 13 connecting the two chain links 11.1 and 12.1 of the two sections 11 or 12, respectively. When it is appreciated that the positioning device is a part of an automatically operated chain welding machine, it will be apparent that the approximately vertically advancing section 11 of the length of chain 9, withdrawn, for example, from a container, contains unwelded chain links while the discharging section 12, which is connected to a conveyor gripping device of the machine along a chain line, has welded chain links and that the uppermost chain link 13 will be the next one to be welded or has already been welded.

With respect to the median plane 8, the chain links of the sections 11 and 12 of the length of chain 9 are arranged successively in such a manner that their longitudinal axes are approximately in the median plane 8. Furthermore, there are arranged, at each section 11 or 12 of the length of chain 9, the first odd-numbered chain links 0.1, 0.3, etc., as well as the first even-numbered chain links 0.2, 0.4, etc., each in a respective plane inclined with respect to the vertical and horizontal planes and each forming, together with the other respective plane, approximately a right angle and an angle of about ±45° with the median plane 8, respectively. Deviations from these two angular dimensions result when the sections 11 and 12 of the length of chain 9 do not have substantially straight longitudinal axes but hang down or sag, respectively, as shown in FIG. 1. The plane of the uppermost chain link 13 and the median plane 8 also form an angle of 45°. With its lower straight wire or rod section, the chain link 13 is located on the plane horizontal section 7 of the supporting surface 5–7. Each of the two circular-cylindrical sections 5 and 6 essentially touch, at one point, one of the straight wire sections of the chain links 12.1 or 11.1 and 11.2, respectively. Overall, it will be seen that each of the chain links resting against the bolt 3 assumes a position on the bolt 3 which is dependent upon its own dimensions and the relative dimensions of the bolt and, apart from that, solely determined by gravitational forces acting upon it.

After the length of chain 9 has been moved by the length of one chain link along its axis 10, a mirror-image chain link arrangement results with respect to the median plane 8. The most important feature of this arrangement is the fact that the first chain link 11.1 of the advancing section 11 of the length of chain 9 has now become the uppermost chain link 13' whose position is indicated in FIG. 2 in dotted lines and the plane of which forms approximately a right angle with the plane of the former chain link 13. After the length of chain 9 has again been moved by one chain link, there results again the arrangement of the chain links shown in the drawing whereby, for example, the former chain link 11.3 has moved to the place of the former chain link 11.1.

It is to be emphasized that, after each movement of the chain, an approximately half-erected chain link is located on the top of the bolt 3 which need now only be rotated the remaining approximately 45° into the median plane 8 and held in this position for the processing of its upper horizontal wire section as explained in the aforementioned West German Pat. No. 2,347,763.

Although only a preferred embodiment is specifically illustrated and described herein, it will be appreciated that many modifications and variations of the present invention are possible in light of the above teachings and within the purview of the appended claims without departing from the spirit and intended scope of the invention.

What is claimed is:

1. In an apparatus for positioning the chain links of a length of chain having a longitudinal axis, said chain being movable step-by-step upwardly then downwardly over a vertex defined by a saddle, said vertex being located in a vertical median plane containing the longitudinal axis of said length of chain, the improvement comprising said saddle having a cylindrical supporting surface, said surface defined by a directrix extending vertically and lying in said vertical median plane and a generatrix extending horizontally and lying perpendicularly to said vertical median plane, and said saddle formed as an elongated bolt.

2. The improvement according to claim 1, wherein at least a portion of said cylindrical supporting surface has a circular directrix.

3. The improvement according to claim 1, wherein said elongated bolt has a circular cross-section.

4. In an apparatus for positioning the chain links of a length of chain having a longitudinal axis, said chain being movable step-by-step upwardly then downwardly over a vertex defined by a saddle, said vertex being located in a vertical median plane containing the longitudinal axis of said length of chain, the improvement comprising said saddle having a cylindrical supporting surface, said surface defined by a directrix extending vertically and lying in said vertical median plane and a generatrix extending horizontally and lying perpendicularly to said vertical median plane, and said surface further including first and second sections having concentric circular directrices and a third section comprising a plane horizontal section arranged over said first and second sections.

5. The improvement according to claim 4, wherein said saddle comprises a bolt having a circular cross-section, and said plane horizontal section comprises a flattened top portion of said elongated bolt.

* * * * *